US005702194A

United States Patent [19]

Hsu

[11] Patent Number: 5,702,194

[45] Date of Patent: Dec. 30, 1997

[54] CLEANER

[76] Inventor: Shih Hsiung Hsu, P.O. Box 90, Tainan 704, Taiwan

[21] Appl. No.: 677,685

[22] Filed: Jul. 8, 1996

[51] Int. Cl.[6] ..... A46B 11/06

[52] U.S. Cl. ..... 401/136; 401/36; 401/281; 401/284; 401/289

[58] Field of Search ..... 401/136, 36, 281, 401/284, 289

[56] References Cited

U.S. PATENT DOCUMENTS

| | | | |
|---|---|---|---|
| 1,310,290 | 7/1919 | Piechowiez | 401/136 |
| 1,343,490 | 6/1920 | Albertson | 401/136 X |
| 1,413,700 | 4/1922 | Allen | 401/136 |
| 2,860,357 | 11/1958 | Teters | 401/136 X |

FOREIGN PATENT DOCUMENTS

| | | | |
|---|---|---|---|
| 573462 | 6/1924 | France | 401/136 |
| 1060141 | 3/1954 | France | 401/136 |
| 333900 | 2/1929 | United Kingdom | 401/136 |

*Primary Examiner*—Steven A. Bratlie
*Attorney, Agent, or Firm*—Bacon & Thomas

[57] ABSTRACT

Water flow through the main body and a cover of a cleaner is regulated by a flow guide having an L-shaped flow groove which permits water flow through the cleaner to be selectively terminated or directed through either a straight outlet for direct contact with an object to be cleaned or through a spray outlet of the main body for flow down and around an invertible cleaning block through an annular space formed in the cover.

2 Claims, 8 Drawing Sheets

CLEANER

BACKGROUND OF THE INVENTION

This invention concerns a cleaner, and particularly a cleaner for cleaning with water only, or by means of a brush or a sponge with water, by manually rotating a flow guide and inverting a cleaning block.

At present, in washing doors, windows or cars, water hoses are generally used to first spray and water down the surfaces and then the watered surfaces are scrubbed with a sponge or brush. Water is then sprayed on the scrubbed surfaces once again to remove remaining dirt. This kind of cleaning needs frequent manipulation of the water hoses and a water faucet, and is quite ineffective and tiresome.

SUMMARY OF THE INVENTION

This invention provides a simple but convenient cleaner at low cost.

The present invention primarily comprises a main body having a longitudinal passageway, a flow guide recess in front of the passageway for receiving a flow guide, a straight outlet in front of the guide recess, a spray outlet in a lower wall of the guide recess, a contact flange formed below the spray outlet and a rear end connection portion for attachment to a water tube. Further, a fixing ring fits around the contact flange of the main body and has female threads which engage with male threads of an annular projection extending from a rectangular-shaped cover having an open bottom side. The cover has an inner chamber for receiving a cleaning block to fit firmly therein for scrubbing. The block includes a brush and a sponge on its upper and lower sides so that the block can be inverted to position the brush or the sponge in a downward facing position for cleaning.

Another feature of the present invention is a rotatable flow guide placed in the guide recess of the main body and having three positions for permitting water flow through a straight exit or a spray exit, or terminating water flow.

BRIEF DESCRIPTION OF THE DRAWINGS

This invention will be better understood by reference to the accompanying drawings, wherein.

DETAILED DESCRIPTION OF THE PREFERRED EMBODIMENT

Figure 1:
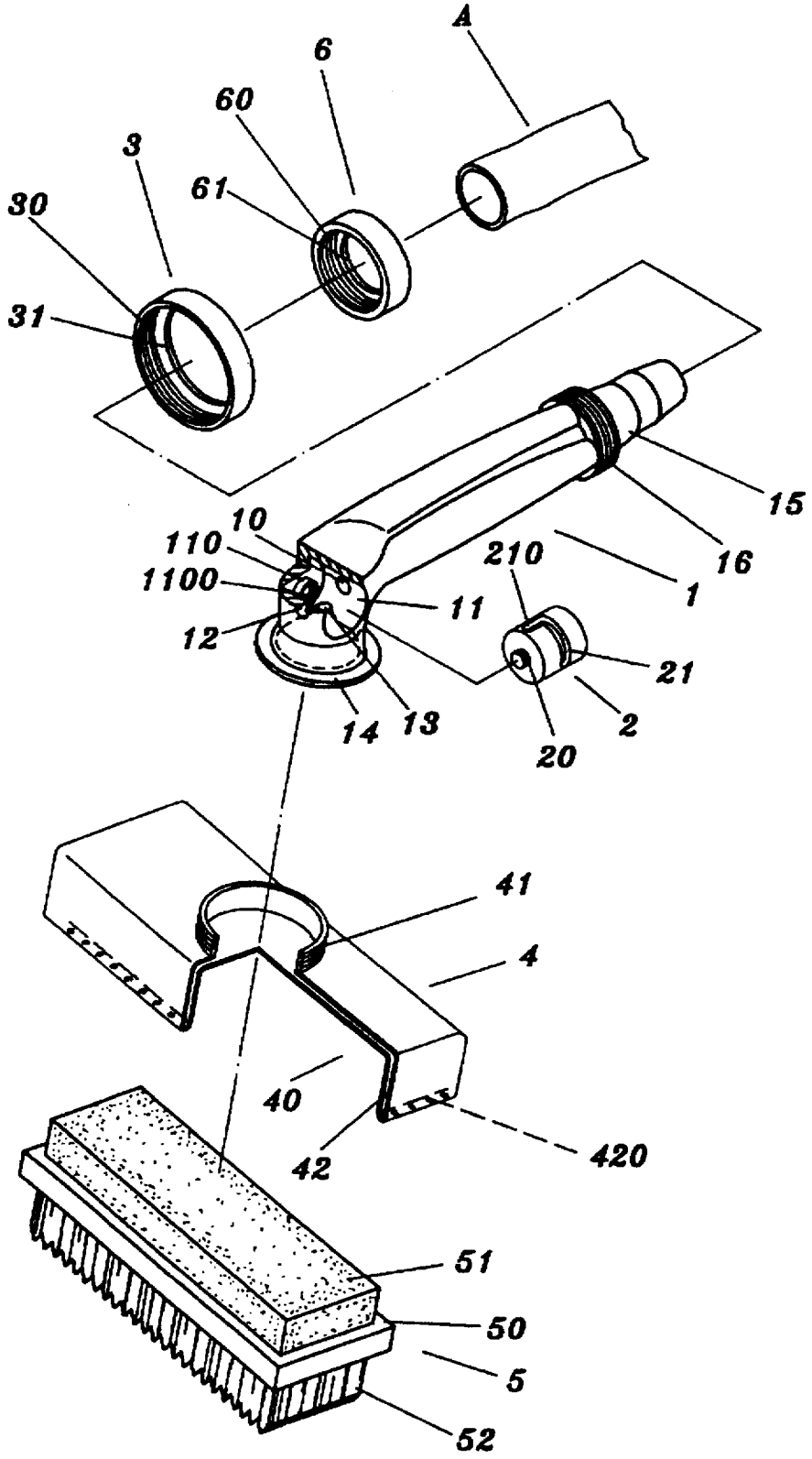
FIG. 1 is an exploded prospective view of a cleaner according to the present invention.

A preferred embodiment of a cleaner according to the present invention, as shown in FIG. 1, includes a main body 1, a flow guide 2, a fixing ring 3, a cover 4, a cleaning block 5, and a constriction ring 7 combined together.

The main body 1 has a longitudinal water passage way 10 extending throughout its entire body, a substantially circular guide recess 11 formed near a front end, an annular projection 110 formed on a left side wall defining the guide recess 11 and having female threads 1100, a straight outlet 12 formed in front of the guide recess 11, a spray outlet 13 formed in a lower side of the guide recess 11, and an annular contact flange 14 below the spray outlet 13 at a lower end of the front section. The main body 1 further has a rear end connection portion 15 provided with male threads 16 at its front section.

The flow guide 2 is fired in the guide recess 11 of the main body 1, is shaped as a cylindrical short post, and includes male threads 20 formed on a small round projection at a center of a rear end surface thereof to engage with the female threads 1100 of the annular projection 110 of the main body 1, and an L-shaped flow groove 21 with a bent leg portion 210 formed in an outer peripheral surface for guiding water flow.

The fixing ring 3 fits around the annular contact flange 14 of the main body 1, and includes female threads 30 and an annular contact flange 31 behind the female threads 30.

The cover 4 is shaped like a rectangular case with an open bottom side and includes an inner chamber 40 surrounded by four side walls and an upper wall, a hole in a center portion of the upper wall, and an annular flange provided with male threads 41 extending up from the edge of the hole to engage the female threads 30 of the fixing ring 3 so that the cover 4 may be combined with the main body 1 and be rotated relative to the main body 1. The cover 4 further has an inner annular space 42 formed between an outer layer and an inner layer of all four side walls and the upper wall, and plural outlet holes 420 are formed in a lower peripheral end edge.

The cleaning block 5 is placed in the inner chamber 40 of the cover 4 and is secured therein by an intermediate engaging member 50. An upper sponge member 51 and a lower brush member 52 are provided on opposite sides of the engaging member 50.

The constriction ring 6 has female threads 60 to engage the male threads 16 of the main body 1, and an inner annular edge 61 at a rear end for constricting a water tube A after the water tube A is fitted around the rear end connection portion 15 of the main body 1.

Figure 2:
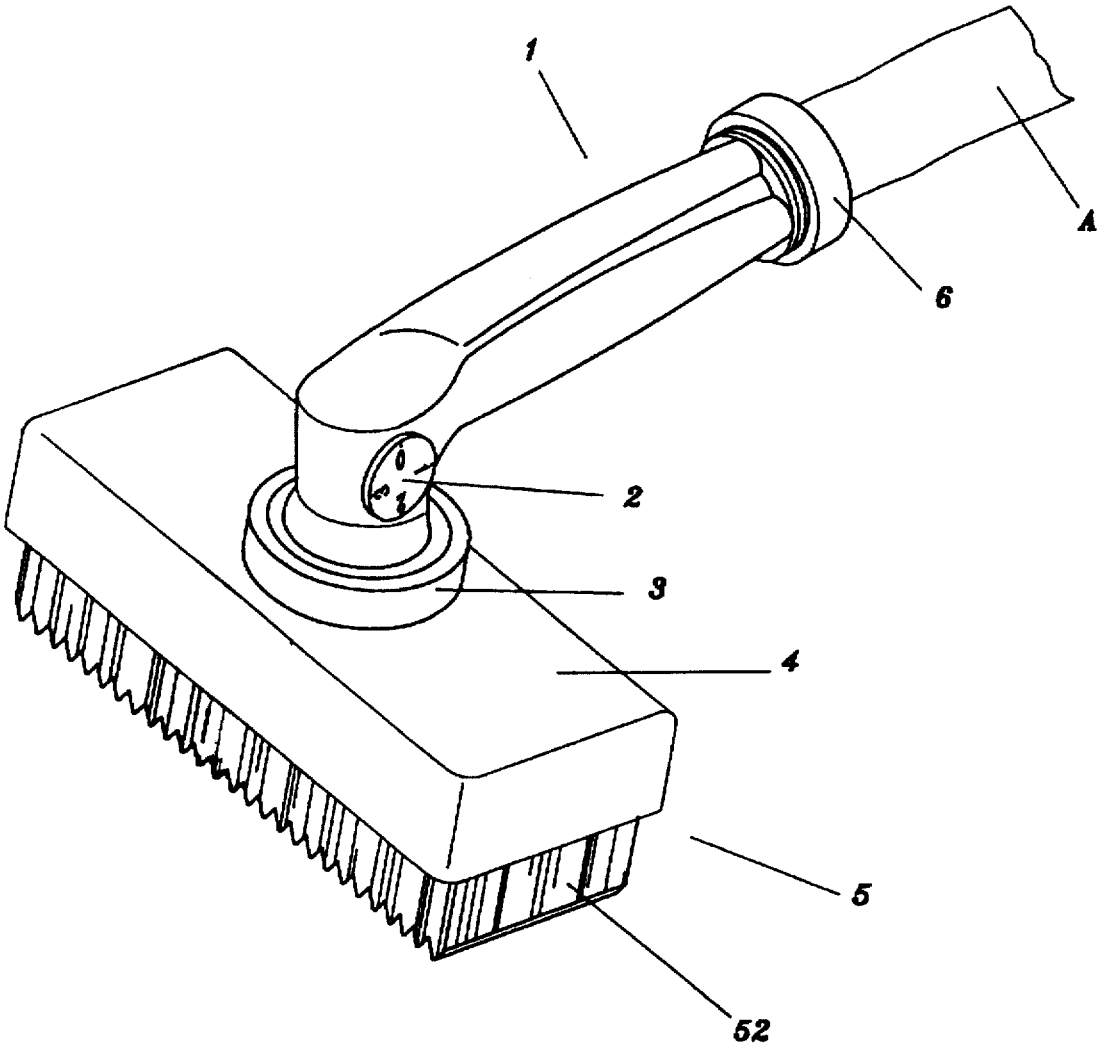
FIG. 2 is a prospective view of the assembled cleaner of the present invention.
Figure 3:
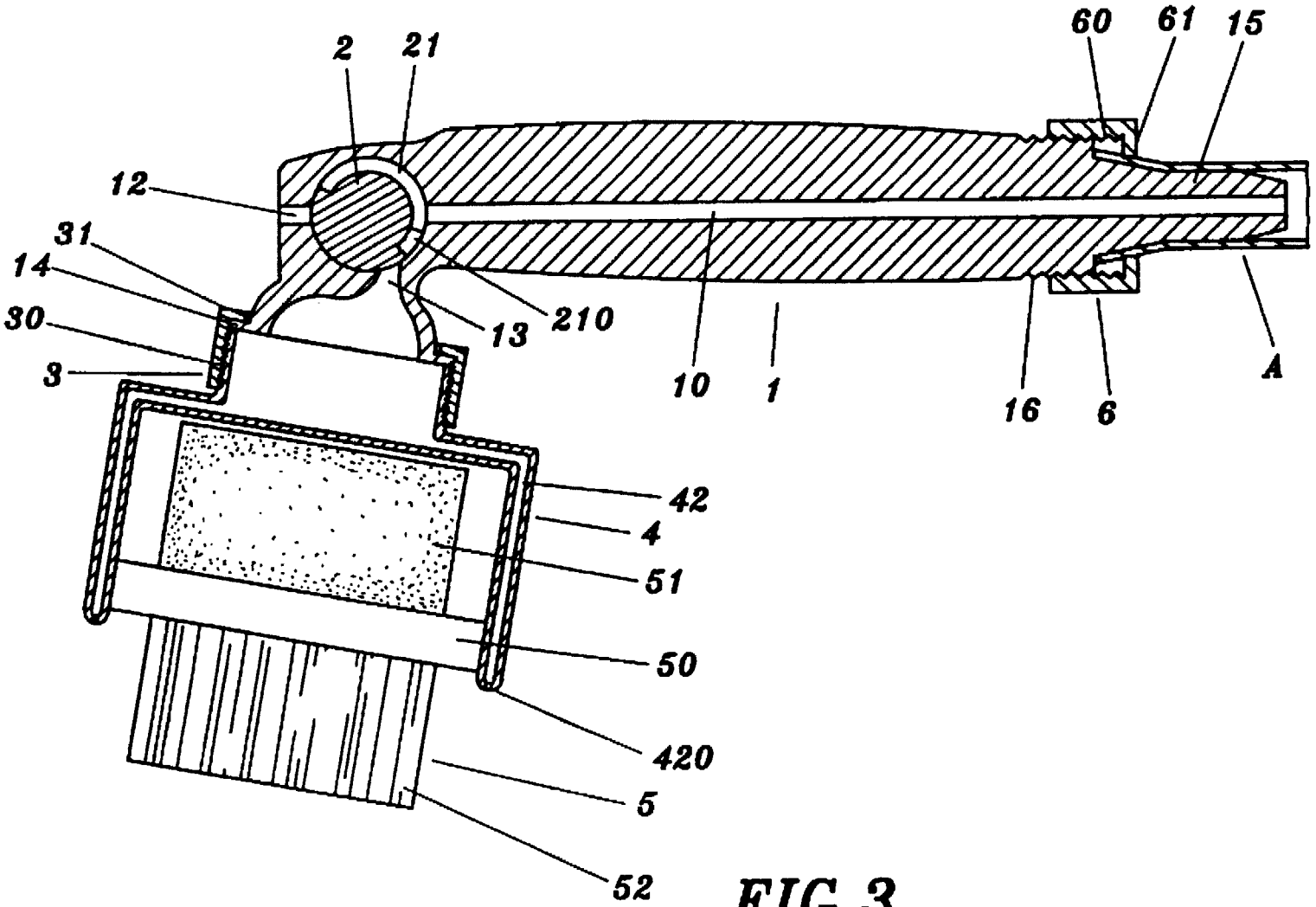
FIG. 3 is a cross-sectional view of the cleaner of the present invention.
Figure 4:
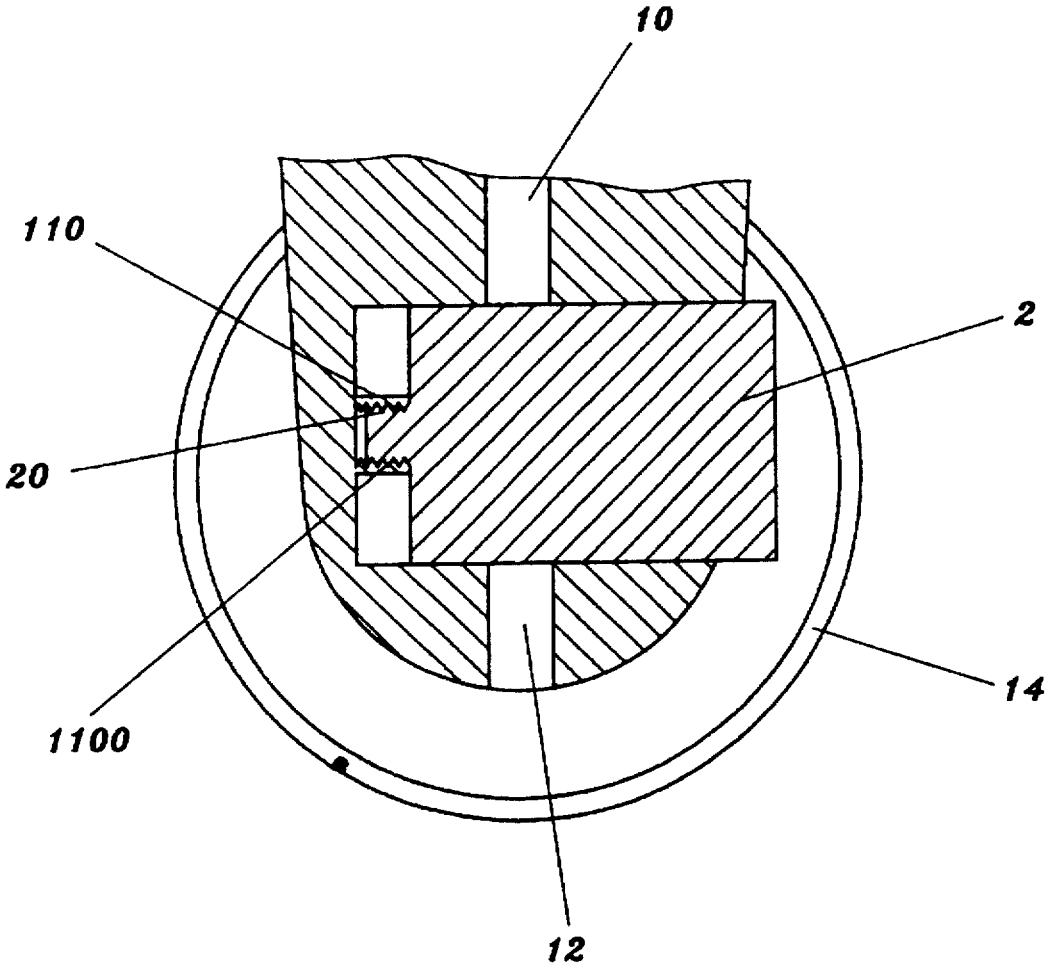
FIG. 4 is a partial cross-sectional view of the flow guide in the cleaner of the present invention.

In assembling, referring to FIGS. 2, 3 and 4, the fixing ring 3 is first placed around and moved forwardly on the main body from its rear end to its front end and positioned around the annular contact flange 14 into engagement with the annular contact flange 31. Next, the male threads 41 of the cover 4 is engaged on the female threads 30 of the fixing ring 3, and then the cleaning block 5 is placed in the inner chamber 40 of the cover 4, with the engaging member 50 fitting tightly around the inner wall of the inner chamber 40 to prevent the cleaning block 5 from falling out. The flow guide 2 is then placed in the guide recess 11 of the main body 1, with the male threads 20 engaging the female threads 1100 of the annular projection 110 to securely maintain the flow guide 2 in position. Then constriction ring 6 is placed around the water tube A, and the connection portion 15 of the main body 1 is inserted tightly in the mouth of the water tube A. The constriction ring 6 is moved forward into engagement with portion 15 so that the female threads 60 engage the male thread 16 to constrict the water tube A with the annular edge 61, thus connecting the water tube A with the main body 1 in a firm and secured condition for complete assembly of the cleaner.

Figure 5:
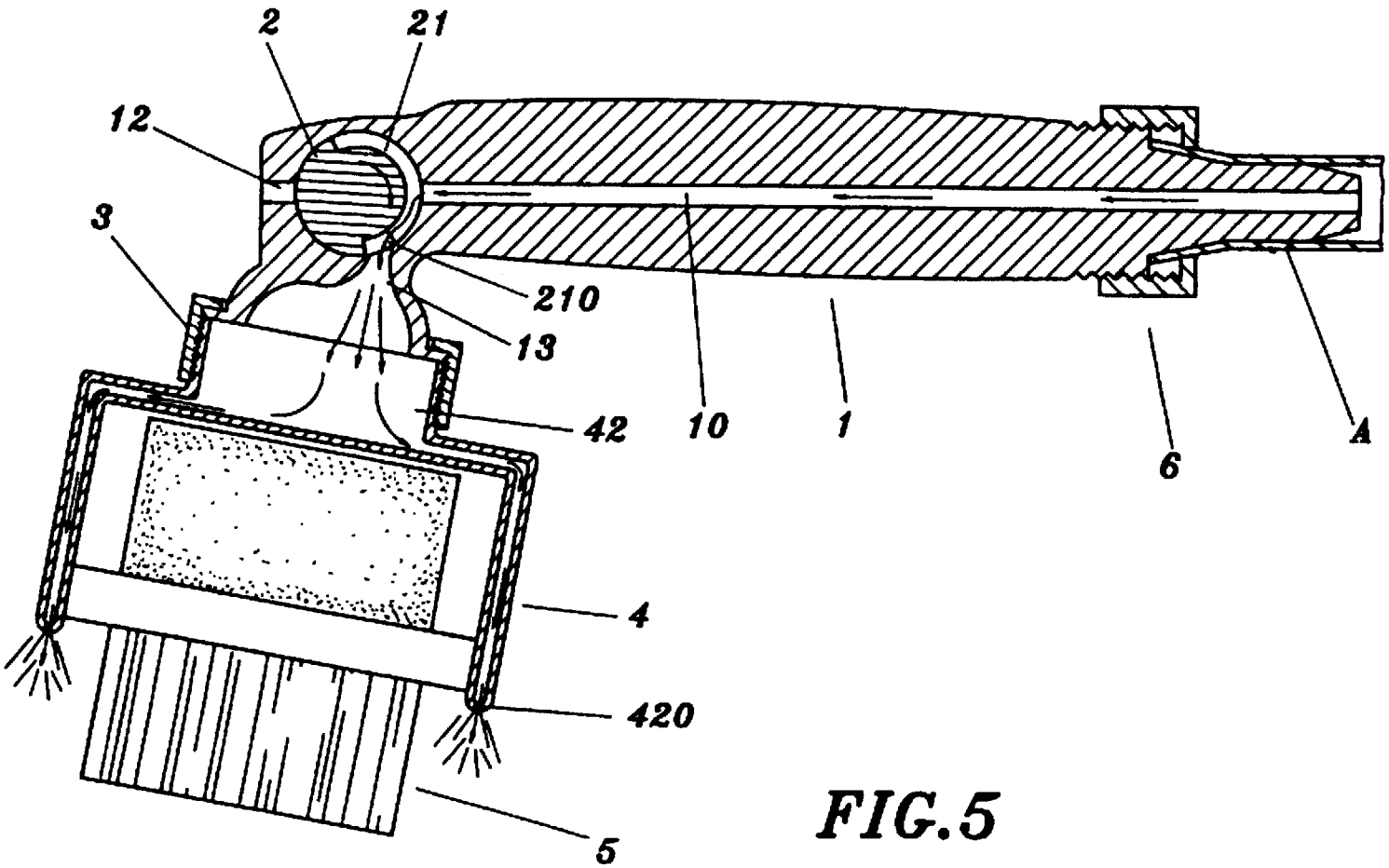
FIG. 5 is a cross-sectional view of the cleaner of the present invention, showing water flow through a spray exit and down over and around the cleaner block.

In use, referring to FIGS. 5, 6, 7 and 8, water may flow through the water tube A, the water passage way 10 of the main body 1, and stopped by flow guide 2 in a first position shown in FIG. 3. Then the flow guide is manually rotated about an angle from a first position to a second position, shown in FIG. 5, to permit the bent leg portion 210 of the flow groove 21 to communicate with the spray outlet 13 of the main body 1 so that water may flow through the straight portion and then through the bent leg portion 210 of the flow groove 21 to reach the spray outlet 13. The water will also flow through the inner annular space 42 of the cover 4 and out the outlet holes 420 down and around the cleaning block 5 and out of the cleaner onto an object to be cleaned, as seen in FIG. 5.

Figure 6:
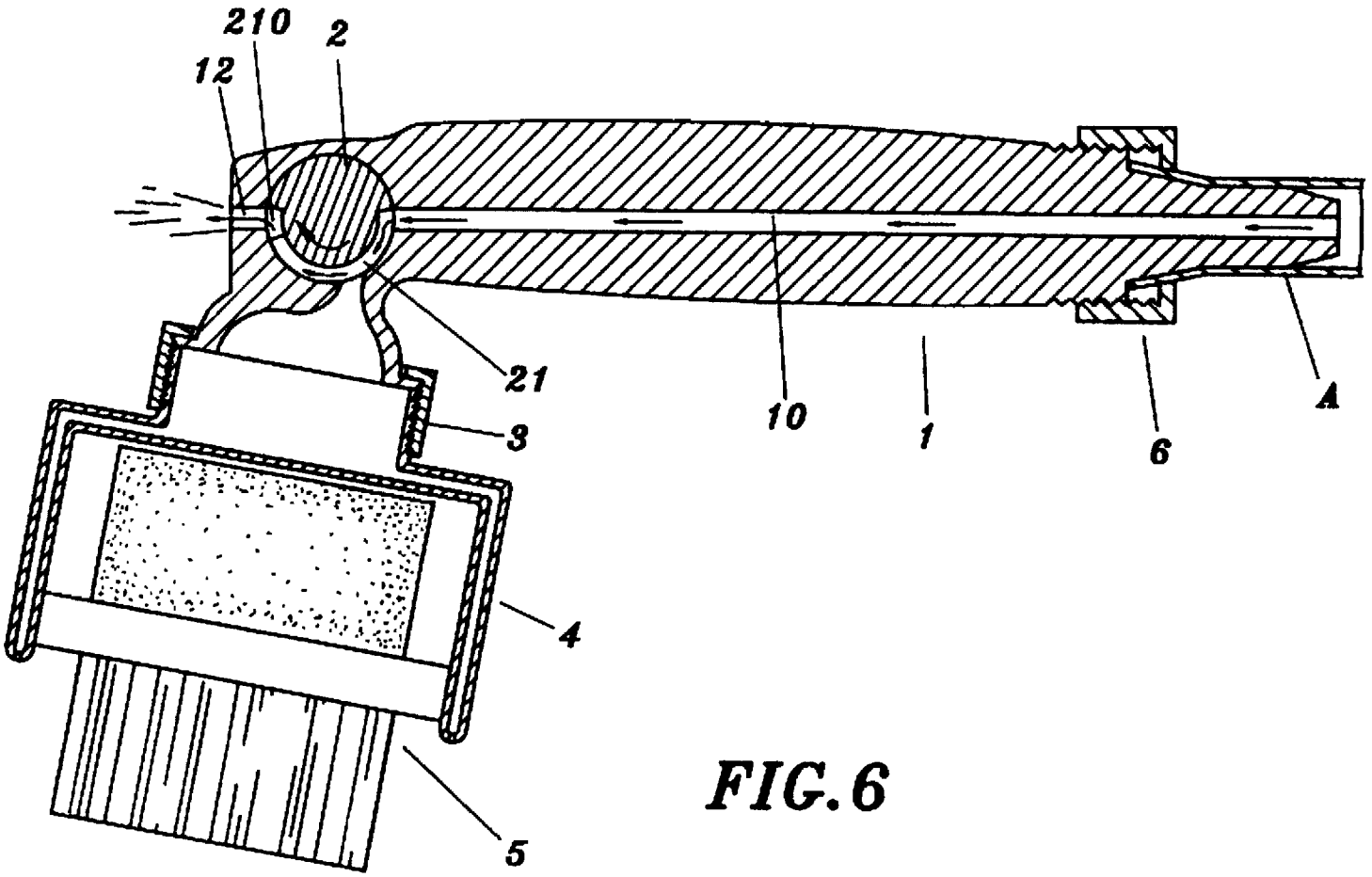
FIG. 6 is a cross-sectional view of the cleaner of the present invention, showing water flow through a spray outlet of the cleaner.
Figure 7:
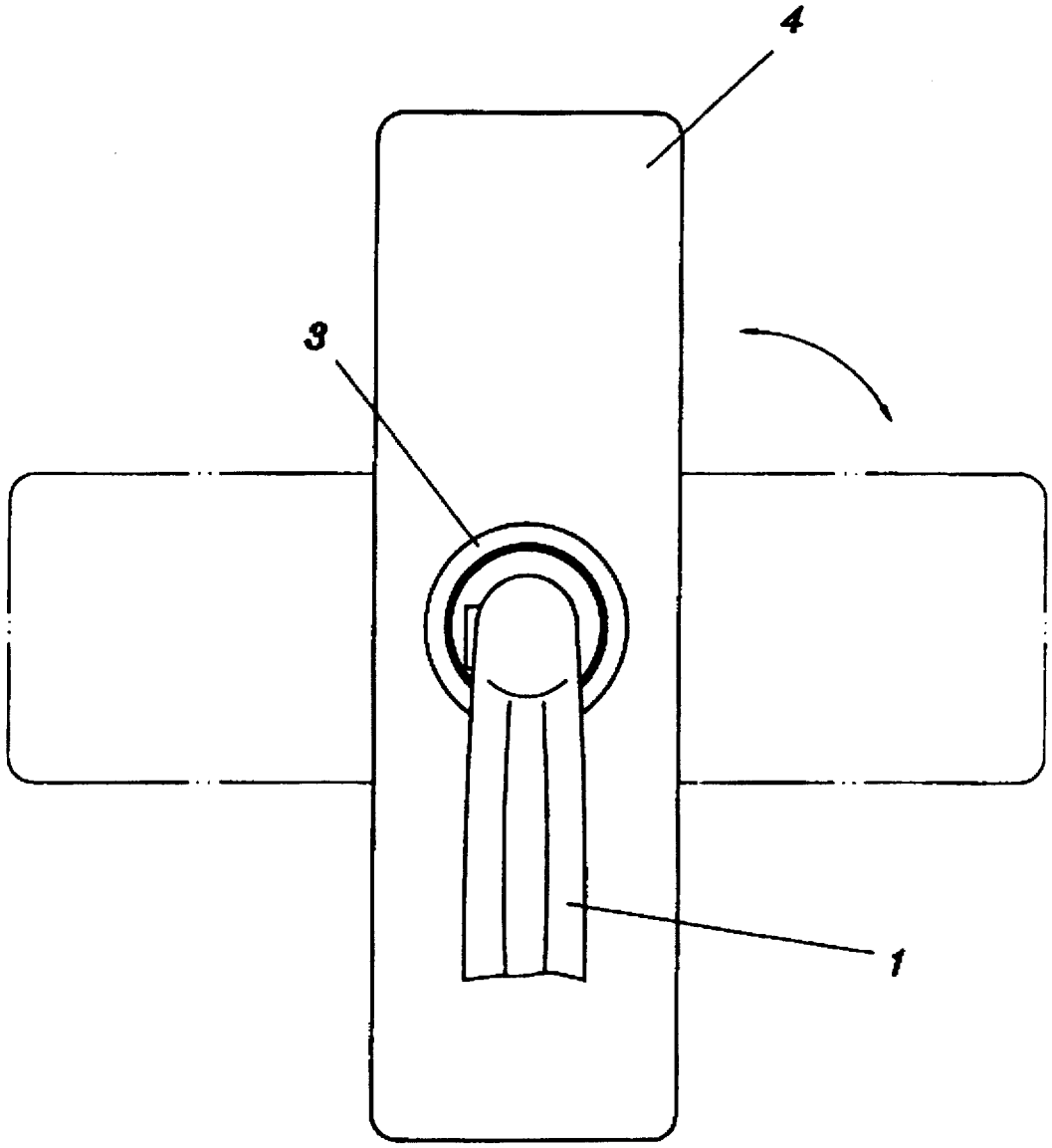
FIG. 7 is an upper view of the cover in the cleaner shown in two different positions of rotation.
Figure 8:
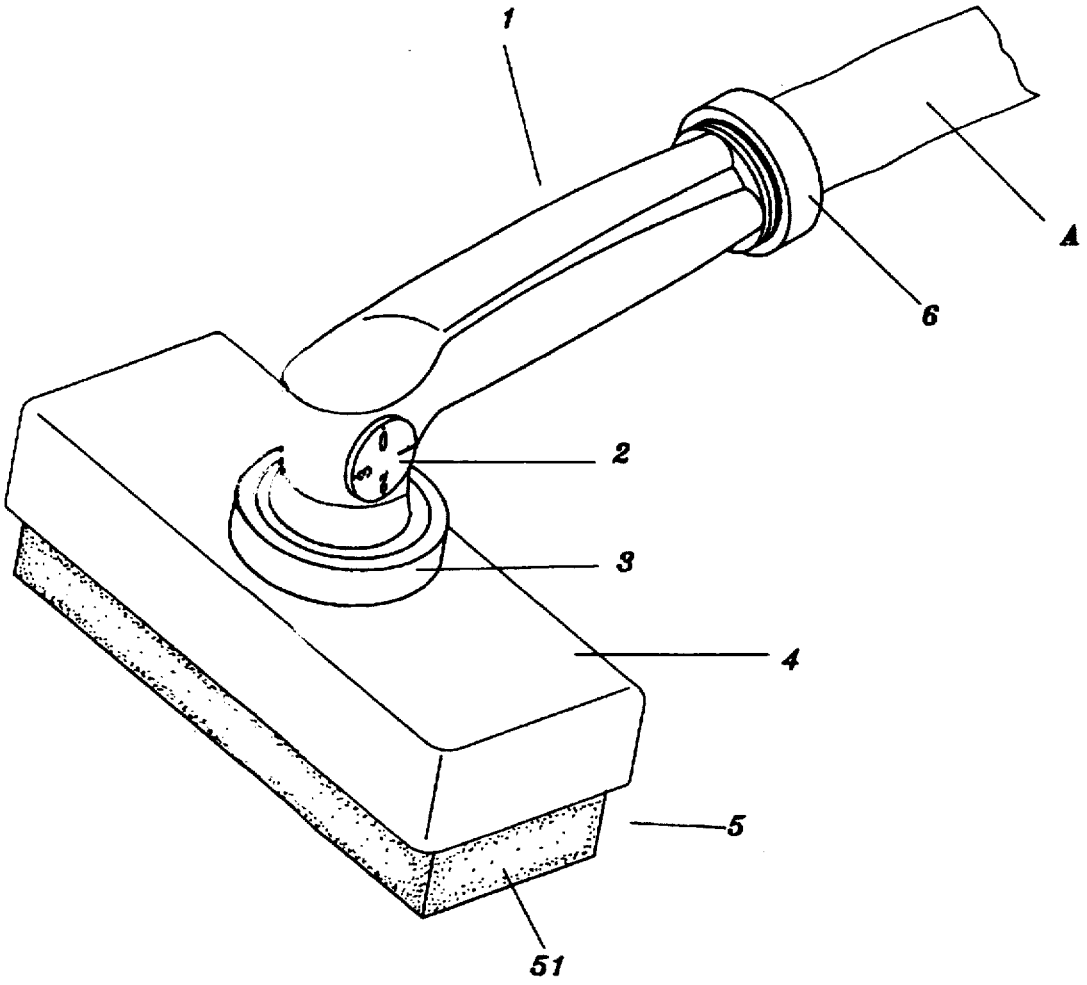
FIG. 8 is a perspective view of the cleaner in the present invention, showing the cleaning block inverted to provide a sponge cleaning face.

If the flow guide 2 is further rotated from the second position about an angle to position the bent leg portion 210 into communication with the straight outlet 12, the spray outlet 13 will be blocked by the outer wall of the flow guide 2, and water may flow through the bent leg portion 210 straight through outlet 12 and directly onto an object to be cleaned, as seen in FIG. 6.

Further, the cover 4 can be rotated 360° relative to the main body 1 and maintained at any position for convenience of cleaning by means of the male and female thread engagement of the cover 4 and the fixing ring 3.

In addition, the cleaning block 5 can be inverted in the cover 4 to dispose the sponge member 51 in a downward position of use.

As can be understood from the above description, the cleaner in the present invention has the advantages listed below.

1. Its assembly is quick and secure.
2. Able to dean directly with water or with a sponge or a brush with water, as needed, and is very convenient to handle.
3. The cleaning block can be easily inverted to use a sponge or a brush, as needed.
4. Water flow can be temporarily stopped, as needed, by manually turning the flow guide. This is simple to operate and saves water.

While the preferred embodiment of the invention has been described above, it will be recognized and understood that various modifications may be made thereto and the appended claims are intended to cover all such modifications which may fall within the spirit and scope of the invention.

I claim:

1. A cleaner comprising:

a) a main body including a front end, a longitudinal water passageway extending therethrough, a straight outlet in the front end, a guide recess, a spray outlet in a lower wall below the guide recess, an annular contact flange below the spray outlet, and a rear end for engagement with a water supply tube;

b) a flow guide disposed within the guide recess, the flow guide including an L-shaped flow groove on a peripheral surface thereof, the flow guide being rotatable within the guide recess for selective disposition between any one of three different water flow positions, including terminating water flow, permitting water flow through the straight outlet and permitting water flow through the spray outlet;

c) a rectangular-shaped cover including four side walls and an upper wall defining an inner chamber having an open bottom side, the walls each including an outer layer spaced from an inner layer, the spaces between the inner and outer layers collectively defining an inner annular space terminating in a plurality of outlet holes around a lower circumferential edge of the side walls, a threaded annular projection extending from the upper wall for receiving water flow from the main body and directing same through the inner annular space and out the outlet holes;

d) a threaded fixing ring disposed in an engagement with the annular contact flange of the main body and in threaded engagement with the threaded annular projection of the cover for securing the main body to the cover and permitting the cover to be rotated relative to the main body;

e) a cleaning block disposed within the inner chamber of the cover, the block including an engaging member for detachably securing the block to the inner chamber, a brush and a sponge extending from opposite sides of the engaging member and the block being invertible for selectively disposing the brush or the sponge in a downwardly facing position of use; and f) a constriction ring engageable with the rear end of the main body for securing a water supply tube thereto.

2. The cleaner of claim 1 wherein the guide recess includes a side wall having a threaded annular projection thereon, the flow guide including a rear end surface having a threaded projection thereon, and the threaded projections of the guide recess and the flow guide being in threaded engagement with each other.

* * * * *